US007088939B2

(12) United States Patent
Maeshima et al.

(10) Patent No.: US 7,088,939 B2
(45) Date of Patent: Aug. 8, 2006

(54) PROCESS CARTRIDGE AND ELECTROPHOTOGRAPHIC IMAGE FORMING APPARATUS

(75) Inventors: Hideki Maeshima, Mishima (JP); Susumu Nittani, Shizuoka-ken (JP); Masatomo Tsuzuki, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 173 days.

(21) Appl. No.: 10/896,281

(22) Filed: Jul. 22, 2004

(65) Prior Publication Data

US 2005/0036803 A1 Feb. 17, 2005

(30) Foreign Application Priority Data

Jul. 25, 2003 (JP) ..... 2003-280121
May 24, 2004 (JP) ..... 2004-152969

(51) Int. Cl.
*G03G 21/16* (2006.01)

(52) U.S. Cl. ..... 399/111; 399/115

(58) Field of Classification Search ..... 399/107, 399/108, 109, 110, 111, 115
See application file for complete search history.

(56) References Cited

U.S. PATENT DOCUMENTS

| | | | | |
|---|---|---|---|---|
| 6,459,869 | B1 | 10/2002 | Nittani et al. | 399/111 |
| 6,463,234 | B1 | 10/2002 | Arimitsu et al. | 399/113 |
| 6,681,088 | B1 | 1/2004 | Kanno et al. | 399/111 |
| 2002/0057924 | A1* | 5/2002 | Ueno et al. | 399/117 |
| 2003/0156855 | A1 | 8/2003 | Nittani et al. | 399/106 |
| 2003/0156856 | A1 | 8/2003 | Arimitsu et al. | 399/114 |
| 2003/0185587 | A1 | 10/2003 | Kawai et al. | 399/111 |
| 2005/0185989 | A1* | 8/2005 | Kosuge et al. | 399/168 |

FOREIGN PATENT DOCUMENTS

| | | |
|---|---|---|
| JP | 2-272594 | 11/1990 |
| JP | 7-199604 | 8/1995 |

* cited by examiner

*Primary Examiner*—Hoan Tran
(74) *Attorney, Agent, or Firm*—Fitzpatrick, Cella, Harper & Scinto

(57) ABSTRACT

A process cartridge detachably mountable to a main assembly of an electrophotographic image forming apparatus, the process cartridge includes an electrophotographic photosensitive drum, a charging member for electrically charging the electrophotographic photosensitive drum, wherein the charging member is supplied with a charging bias voltage received from the main assembly of the electrophotographic image forming apparatus when the process cartridge is mounted to the main assembly of the electrophotographic image forming apparatus; and a charging member rubbing member having an insulative property and provided contacted to the charging member along a longitudinal direction of the charging member; wherein the charging member is contacted within a longitudinally extending range to electrically charge the electrophotographic photosensitive drum, and wherein the charging member rubbing member is disposed between the electroconductive member and the charging member beyond an end of the range to prevent leakage of current from the charging member to the electroconductive member when the charging member is supplied with the charging bias.

8 Claims, 15 Drawing Sheets

PROCESS CARTRIDGE AND ELECTROPHOTOGRAPHIC IMAGE FORMING APPARATUS

FIELD OF THE INVENTION AND RELATED ART

The present invention relates to an electrophotographic image forming apparatus and a process cartridge employable by an electrophotographic image forming apparatus.

It has been a common practice, in the field of an electrophotographic image forming apparatus employing an electrophotographic image formation process, to employ a process cartridge system, according to which the combination of an electrophotographic photosensitive member and a single or more of processing means which act on the photosensitive drum is integrally placed in a cartridge removably mountable in the main assembly of an electrophotographic image forming apparatus. A process cartridge system makes it possible for a user himself to maintain an electrophotographic image forming apparatus, drastically improving the operational efficiency of an electrophotographic image forming apparatus. Thus, a process cartridge system is widely used in the field of an electrophotographic image forming apparatus.

As for the method for charging the photosensitive drum in a process cartridge, one of the charging methods, in which a charge roller as a charging member is rotated by the rotation of a photosensitive drum has been widely known.

After the completion of the development process, a minute amount of residues such as developer, charge control agents contained in the developer, etc., remains on a photosensitive drum, and these residues are removed by a cleaning member. However, even after the residue removal process, a very minute amount of the residues sometimes remains on the photosensitive drum. No matter how small the amount of the residues remaining on the photosensitive drum, the residues transfers onto the peripheral surface of a charge roller, gradually contaminating there. As a result, the charging member gradually reduces in performance; in other words, the service life of the charging member reduces. Thus, in order to prevent the service life of a charge roller from being reduced by the above described residues, there have been devised various methods for preventing a charge roller from being contaminated by the residues. One of such methods is to provide a charge roller with a charge roller rubbing member (which hereinafter may be referred to simply as "rubbing member") (Patent Documents 1 and 2).

Further, to the charge roller of an electrophotographic image forming apparatus, high voltage is applied. Thus, in order to prevent the electrically current flowing through the charge roller from leaking to the electrically conductive members (components) in the adjacencies of the charge roller, an electrophotographic image forming apparatus is structured so that a certain distance is provided between the charge roller and each of the electrical conductive members (components) in the adjacencies thereof.

Patent Document 1: Japanese Laid-open Patent Application 2-272594

Patent Document 2: Japanese Laid-open Patent Application 7-199604

SUMMARY OF THE INVENTION

In recent years, on the other hand, an image forming apparatus has been desired to be more compact than ever. In order to satisfy this desire, not only must the main assembly of an image forming apparatus be reduced in size, but also, a process cartridge, which occupies a substantial amount of the internal space of the main assembly, must be reduced in size. From this standpoint, it is necessary to reduces in size the components which make up a process cartridge, and also, to cleverly position the components in terms of spatial efficiency. Further, it is necessary to reduce the distance which must be maintained between the adjacent two electrically conductive components. However, if the distance between the adjacent two electrically conductive components is reduced to a value smaller than the aforementioned distance, it is possible that electric current will leak to any of the electrical components in the adjacencies of the charge roller, from a charge roller to which high voltage is being applied. If there is current leak between a charge roller and any of the components in the adjacencies of the charge roller, it becomes impossible to produce an image of high quality. In the past, therefore, the distance from a charge roller to each of the electrically conductive members (components) in the adjacencies of the charge roller was made greater than a predetermined value.

The primary object of the present invention is to provide a process cartridge in which the distance from its charging member to each of the electrically conductive members are shorter than the corresponding distance from the charging member to each of the electrically conductive members in a process cartridge in accordance with the prior art, and an electrophotographic image forming apparatus compatible with such a process cartridge.

Another object of the present invention is to provide a process cartridge in which while charge bias is applied to its charging member, electrical current does not leak from the charging member to any of its electrically conductive members, and an electrophotographic image forming apparatus compatible with such a process cartridge.

Another object of the present invention is to provide a process cartridge smaller than the process cartridges in accordance with the prior art, and an electrophotographic image forming apparatus compatible with such a process cartridge.

Another object of the present invention is to provide a process cartridge in which in terms of the lengthwise direction of its charging member, the charging member rubbing member is made longer than the contact area between the charging member and electrophotographic photosensitive drum, and also, in which not only is the rubbing member given the function of rubbing the peripheral surface of the charging member, but also, the function of preventing electric current from leaking from the charging member to any of the electrically conductive members, and an electrophotographic image forming apparatus compatible with such a process cartridge.

Another object of the present invention is to provide a process cartridge in which electric current leak will not occur even when the process cartridge is used in a severe environment (for example, high humidity environment) in which electric current leak is very likely to occur if a charging member rubbing member is not placed between the charge roller and the electrically conductive members, and an electrophotographic image forming apparatus compatible with such a process cartridge.

The present invention was made in consideration of the above described problem. According to one of the characteristic aspects of the present invention, a process cartridge removably mountable in the main assembly of an electrophotographic image forming apparatus, and comprising: an electrophotographic photosensitive drum; a charging member which charges the photosensitive drum by being is supplied with charge bias from the main assembly of an electrophotographic image forming apparatus, when it is in the main assembly of an electrophotographic image forming apparatus; and a charging member rubbing dielectric member placed in contact with the charging member in parallel to the charging member to remove the foreign substances adhering to the peripheral surface of the charging member, is characterized in that in order to prevent the occurrence of electrical leak between the charging member and any of the electrically conductive members, the charging member rubbing member is positioned between the charging member and electrically conductive members, by being extended beyond both ends of the charging area (contact area) between the charge roller and photosensitive drum, in terms of the lengthwise direction of the charging member, in which the charging member charges the electrophotographic photosensitive drum, and an electrophotographic image forming apparatus is characterized in that it is made compatible with such a process cartridge.

According to another characteristic aspect of the present invention, it is possible to reduce the distance between the charging member and any of the electrically conductive members in a process cartridge, making it possible to reduce in size a process cartridge. Further, in spite of the reduction in cartridge size, electric current does not leak from the charging member to any of the electrically conductive members.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the process cartridge, and the image forming apparatus employing the process cartridge, in the preferred embodiments of the present invention will be described.

Embodiment 1

[General Structure of Color Image Forming Apparatus]

Figure 1:
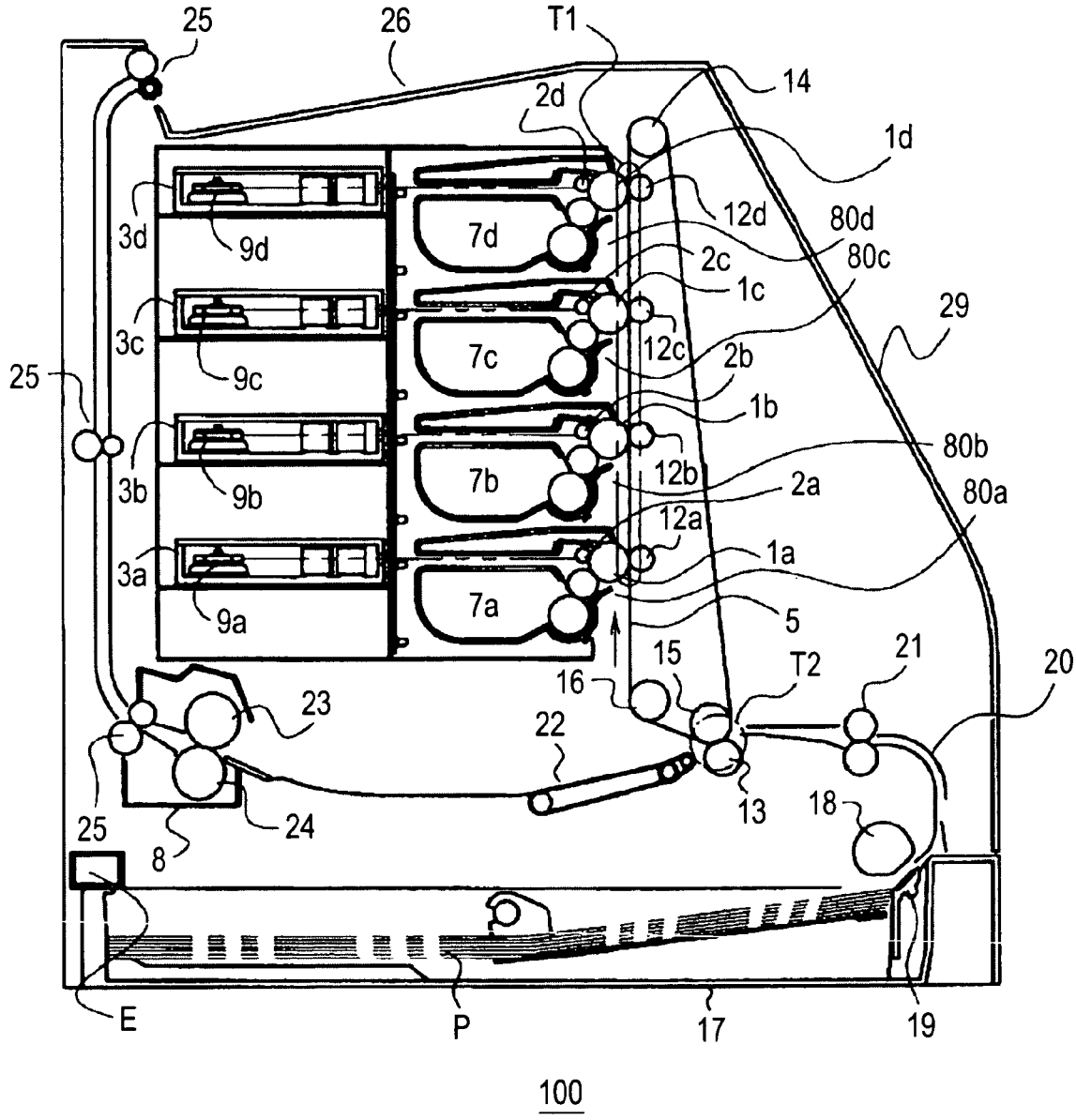
FIG. 1 is a schematic sectional view of the full-color image forming apparatus in the first embodiment of the present invention, showing the general structure thereof.
Figure 2:
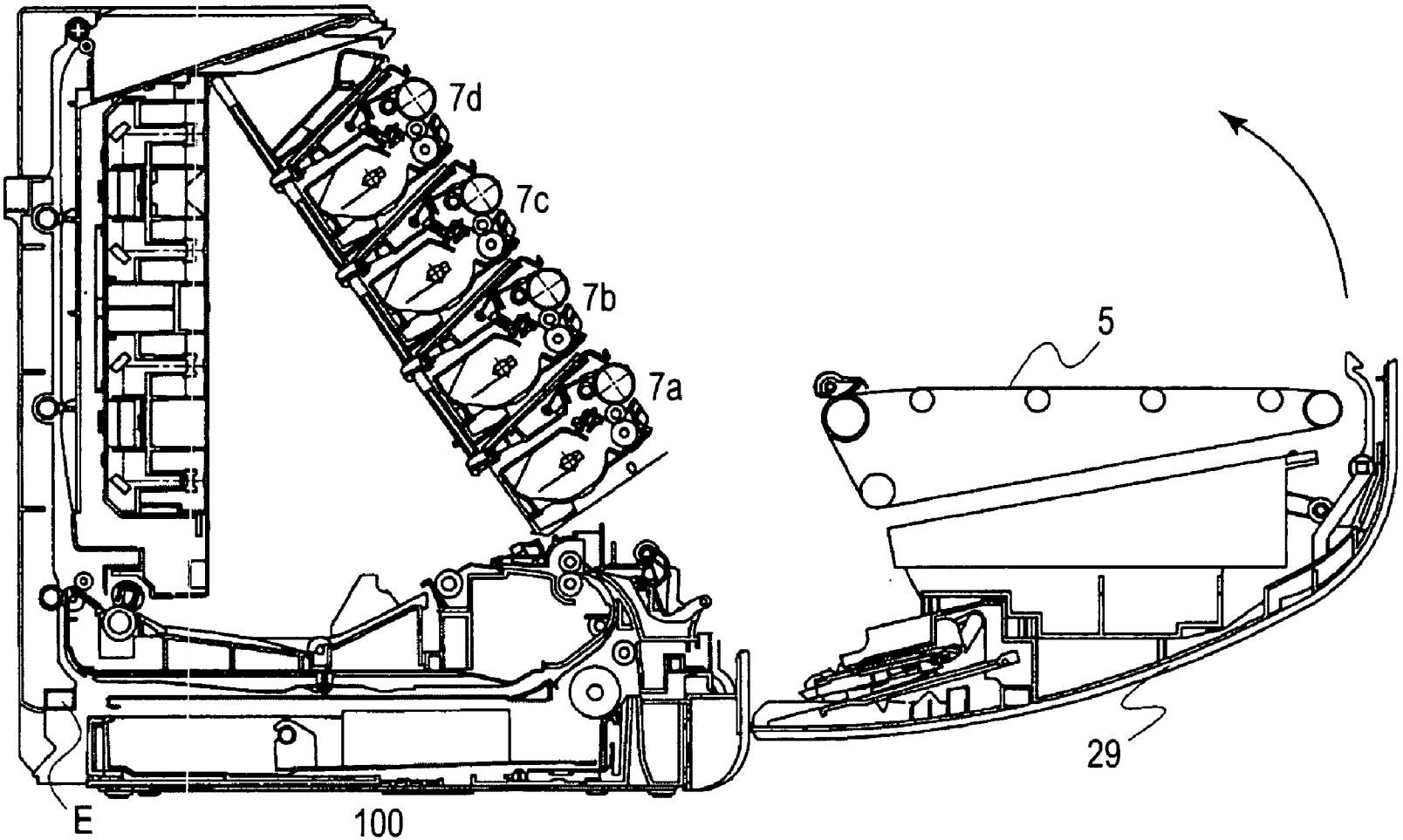
FIG. 2 is a schematic sectional view of the full-color image forming apparatus in the first embodiment of the present invention, showing the general structure thereof.
Figure 3:
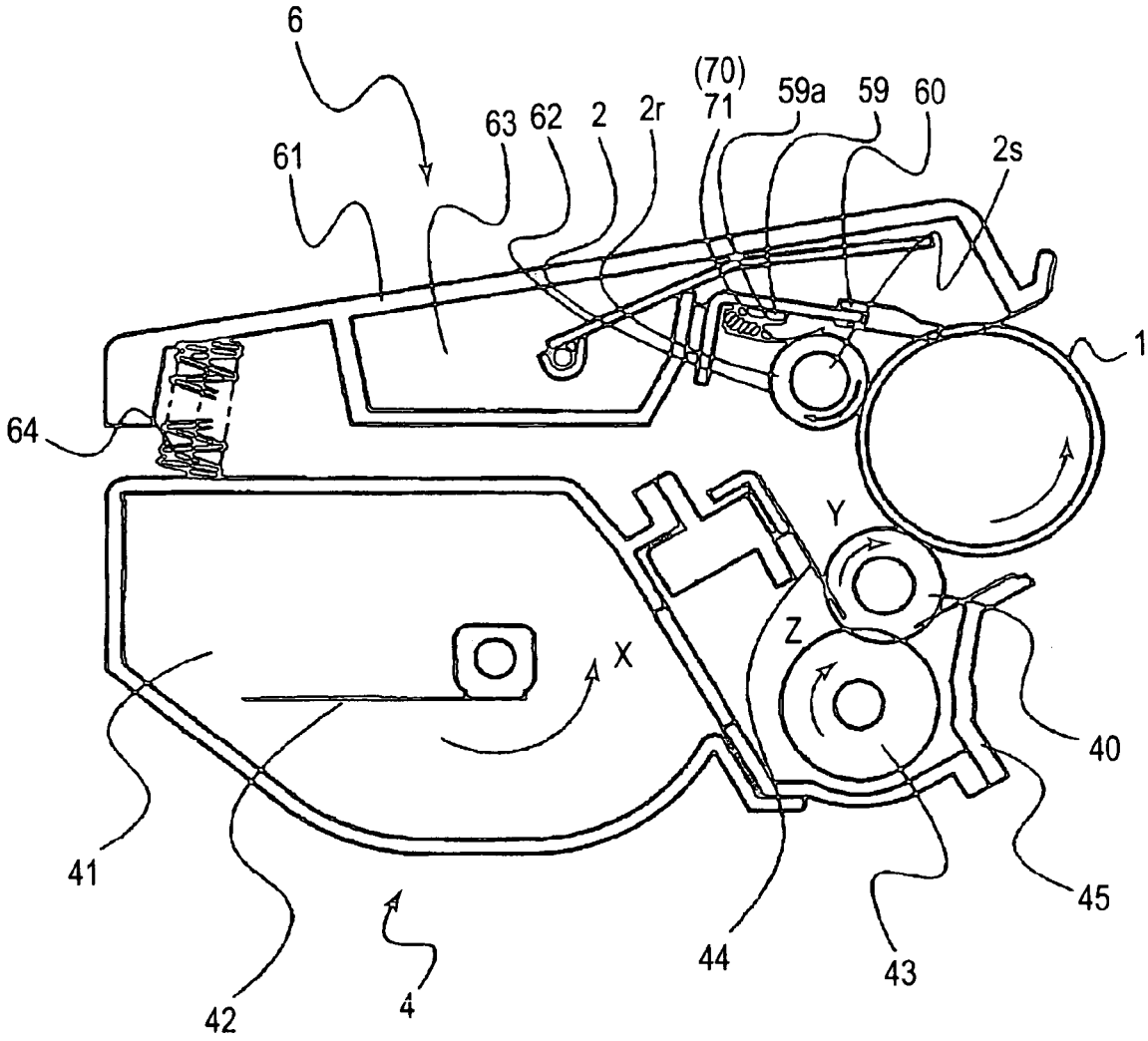
FIG. 3 is a schematic sectional view of the process cartridge in the first embodiment of the present invention, showing the general structure thereof.

First, referring to FIGS. 1–3, the general structure of a typical color image forming apparatus will be described. FIGS. 1 and 2 are drawings for describing the overall structure of a full-color laser printer as an example of a color image forming apparatus, and FIG. 3 is a drawing for depicting the overall structure of the process cartridge employed by the full-color laser printer.

Referring to FIG. 1, the color laser printer comprises four process cartridges 7 (one for each of color components: yellow, magenta, cyan, and black), and an intermediary transferring member 5. Each process cartridge 7 has an electrophotographic photosensitive drum. The intermediary transferring member 5 bears the multiple color toner images developed by the process cartridges 7 and transferred onto the intermediary transferring member 5, and transfers the toner images onto a recording medium P delivered from a recording medium feeding portion. The electrophotographic photosensitive drum 1 (1*a*, 1*b*, 1*c*, and 1*d*) is rotationally driven by a driving means in the counterclockwise direction indicated by an arrow mark in the drawing. Each cartridge 7 further comprises a charge roller 2 (2*a*, 2*b*, 2*c*, and 2*d*) for uniformly charge the peripheral surface of the photosensitive drum 1; a scanner unit 3 (3*a*, 3*b*, 3*c*, and 3*d*) for forming an electrostatic latent image on the photosensitive drum 1 by projecting a beam of laser light while modulating it with image formation information; and a developing apparatus 4 (4*a*, 4*b*, 4*c*, and 4*d*) (FIG. 3) for developing the electrostatic latent image on the photosensitive drum 1 by adhering developer to the electrostatic latent image. The charge roller 2, scanner unit 3, and developing apparatus 4 are disposed in the adjacencies of the peripheral surface of the photosensitive drum 1 in a manner to surround the photosensitive drum 1. The cartridge 7 also comprises a photosensitive drum unit 6 (FIG. 3) which has a drum cleaning apparatus for removing the developer remaining on the peripheral surface of the photosensitive drum 1 after the transfer of the developer image on the photosensitive drum 1 onto the intermediary transferring member 5 in the first transfer station T1, and which also is disposed in the adjacencies of the peripheral surface of the photosensitive drum 1. After being transferred onto the intermediary transferring member 5, The developer image is transferred by a secondary transfer roller 13 onto the recording medium P in the second transfer station T2. Then, the recording medium P is conveyed to the fixation station 8, in which the color image is fixed to the recording medium P. Thereafter, the recording medium P is discharged into a delivery tray 26 by multiple pairs of discharge rollers 25.

The photosensitive drum 1 (1*a*–1*d*), charge roller 2 (2*a*–2*d*), developing apparatus 4 (4*a*–4*d*), and drum cleaning apparatus, are integrally placed in a cartridge, making up the process cartridge 7 (7*a*, 7*b*, 7*c*, and 7*d*), which is removably mountable in one of the cartridge compartments 80 (80*a*, 80*b*, 80*c*, and 80*d*) of the main assembly 100 of the electro-photographic image forming apparatus.

The main assembly 100 of the electrophotographic image forming apparatus has an hinged lid 29, to which the intermediary transferring member 5 is attached. The process cartridge 7 is mounted into, or removed from, the image forming apparatus main assembly 100, from the side opposite to the photosensitive drum 1, with the hinged lid 29 opened as shown in FIG. 2. In other words, the process cartridge 7 is removably mountable in the image forming apparatus main assembly 100.

Next, referring to FIGS. 1 and 3, the various portions, members, etc., of the above described image forming apparatus will be described in detail in the logical order.

[Photosensitive Drum 1]

First, the electrophotographic photosensitive drum 1 will be described in detail.

The photosensitive drum 1 comprises an aluminum cylinder with a diameter of roughly 20–50 mm, and a layer of organic photoconductive substance (OPC photosensitive member) coated on the peripheral surface of the aluminum cylinder. It is rotatably supported by a pair of supporting members, by the lengthwise end portions. The force for driving the photosensitive drum 1 is transmitted from a motor (unshown) to one of the lengthwise ends of the photosensitive drum 1, driving the photosensitive drum 1 in the counterclockwise direction (FIG. 3).

[Charging Member]

The charge roller 2 (2*a*–2*d*) as a charging member is for a contact type charging method. It is an electrically conductive roller. As charge bias is supplied to this roller 2, with the peripheral surface of the charge roller 2 kept in contact with the peripheral surface of the photosensitive drum 1, the peripheral surface of the photosensitive drum 1 is uniformly charged. More specifically, when the process cartridge 7 is in the apparatus main assembly 100, the charging member (which hereinafter may be referred to as "charge roller") is supplied with charge bias from a power source E of the apparatus main assembly 100, uniformly charging the photosensitive drum 1. The charge bias in this embodiment is in the range of 1,000–1,500 (V).

[Exposing Means]

The scanner unit 3 as an exposing means has a laser diode (unshown). As video signals are given to the laser diode, the laser diode emits a beam of laser light, while modulating it with the video signal, toward the polygon mirror 9 (9*a*, 9*b*, 9*c*, and 9*d*), which is being rotated at a high speed by a scanner motor. The beam of laser light is deflected (reflected) by the polygon mirror 9, and selectively exposes, through a focal lens, the numerous points of the peripheral surface of the photosensitive drum 1 which is being rotated. As a result, an electrostatic latent image is formed on the photosensitive drum 1.

[Developing Apparatus]

The developing apparatus 4 develops the electrostatic latent image on the photosensitive drum 1. Therefore, the developing apparatus 4 has a developer storage portion 41 (which stores yellow, magenta, cyan, or black developer). The developer in the developer storage portion 41 is sent to a developer supply roller 43 by a conveying means 21, so that, as the development roller 40 is rotated (in the direction indicated by an arrow mark Y in FIG. 3) the developer is adhered, while being charged, to the peripheral surface of the development roller 40 by the developer supply roller 43, which is being rotated (in the counterclockwise direction in FIG. 3), and a development blade 44 kept pressed on the peripheral surface of the development roller 40.

To the development roller 40 placed in parallel to, and in contact, or virtually in contact, with the peripheral surface of the photosensitive drum 1 bearing the latent image, development bias is supplied from the aforementioned power source E. As a result, the latent image is developed. The development bias in this embodiment is in the range of 300–800 (V).

[Intermediary Transferring Member]

The intermediary transferring member 5 is a member onto which the developer images on the photosensitive drums 1 are transferred in layers. Therefore, it is rotated in the clockwise direction of FIG. 1, at the same peripheral speed as that of each photosensitive drum 1. The developer images formed on the photosensitive drums 1 are transferred in layers onto the intermediary transferring member 5 in the primary transfer stations T1, in which the primary transfer rollers 12 (12*a*, 12*b*, 12*c*, and 12*d*), to which voltage is being applied, are placed on the opposite side of the intermediary transferring member 5 from the photosensitive drums 1, in contact with the intermediary transferring member 5, with the intermediary transferring member 5 pinched between the photosensitive drums 1 and primary transfer rollers 12. After the developer images are transferred in layers onto the intermediary transferring member 5, the portion of the intermediary transferring member 5 bearing the developer images is conveyed through the aforementioned secondary transfer station T2, in which a secondary transfer roller 13, to which voltage is being applied, is placed on outward side of the loop of the intermediary transferring member 5, in contact with the intermediary transferring member 5, and in which the recording medium P is conveyed while remaining pinched by the intermediary transferring member 5 and secondary transfer roller 13. As a result, the developer images, different in color, on the intermediary transferring member 5 are transferred all at once in layers onto the recording medium P.

The intermediary transferring member 5 (intermediary transfer belt) in this embodiment is stretched around three shafts, that is, a driver roller 14, a secondary transfer counter roller 15, and a tension roller 16.

[Recording Medium Feeding Portion]

The recording medium feeding portion is for delivering the recording medium P to the photosensitive drum 1. It comprises a cassette 17 capable of storing a predetermined number of recording mediums P, a recording medium feeding roller 18, a recording medium separating pad 19, a recording medium guide 20, and a pair of registration rollers 21. During an image forming operation, the feeding roller 18 is rotated in synchronism with the progression of the image forming operation, sending the recording mediums P out of the cassette 17, and into the apparatus main assembly 100, while separating them one by one. After being sent into the apparatus main assembly 100, each recording medium P is conveyed further, reaching the pair of registration rollers 21, while being guided by the guide 20. The pair of registration rollers 21 alternately performs the non-rotational operation which keeps the recording medium P on standby, and the rotational operation which sends the recording medium P toward the intermediary transferring member 5, following a predetermined sequence. In other words, the pair of registration rollers 21 releases the recording medium P so that the recording medium P aligns with the images on the intermediary transferring member 5, during the transfer process, that is, the following process.

[Secondary Transfer Station]

The secondary transfer station has the secondary transfer roller 13, which is rotatable, and also, is vertically movable between two positions: a position in which it is kept away from the intermediary transferring member 5, and a position in which it is kept pressed against the counter roller 15, with the intermediary transferring member 5 pinched between the transfer roller 13 and counter roller 15. The transfer roller 15 is rotatable. During an image forming operation, it is moved upward, with a predetermined timing, by a cam (unshown) to be placed in contact with the intermediary transferring member 5, generating a predetermined amount of contact pressure, with the recording medium P remaining pinched between the intermediary transferring member 5 and transfer roller 13, so that the full-color image is transferred onto the recording medium P. At the same time as the transfer roller 13 begins to be placed in contact with the intermediary transferring member 5, bias begins to be applied to the transfer roller 13, and is kept applied thereto until the transfer roller 13 is moved away from the intermediary transferring member 5. As a result, the developer images, different in color, on the intermediary transferring member 5 are transferred onto the recording medium P. Then, the recording medium P is conveyed by a conveyer belt 22 to the fixing device 8, by which the next process is carried out.

[Fixation Station]

The fixing device 8 is for fixing the developer images transferred onto the recording medium P to the recording medium P. It comprises a film guiding unit 23 containing a ceramic heater for applying heat to the recording medium P, and a pressure roller 24 for keeping the recording medium P pressed against the film guiding unit 23.

In the above described color laser printer, the latent image corresponding to the yellow color component, latent image corresponding to the magenta color component, latent image corresponding to the cyan color component, and latent image corresponding to the black color component, are formed in the listed order. Each latent image is developed into a visible image (image formed of developer). Then, the visible image, or the developer image, is transferred onto the intermediary transferring member 5 in the corresponding primary transfer station T1. As a result, a single full-color image is formed of the four monochromatic developer images, that is, yellow, magenta, cyan, and black developer images, on the surface of the intermediary transferring member 5. This full-color image is transferred onto the recording medium P. Then, the full-color image is fixed to the recording medium P, yielding a full-color copy of the intended image.

[Structure of Process Cartridge]

Figure 4:
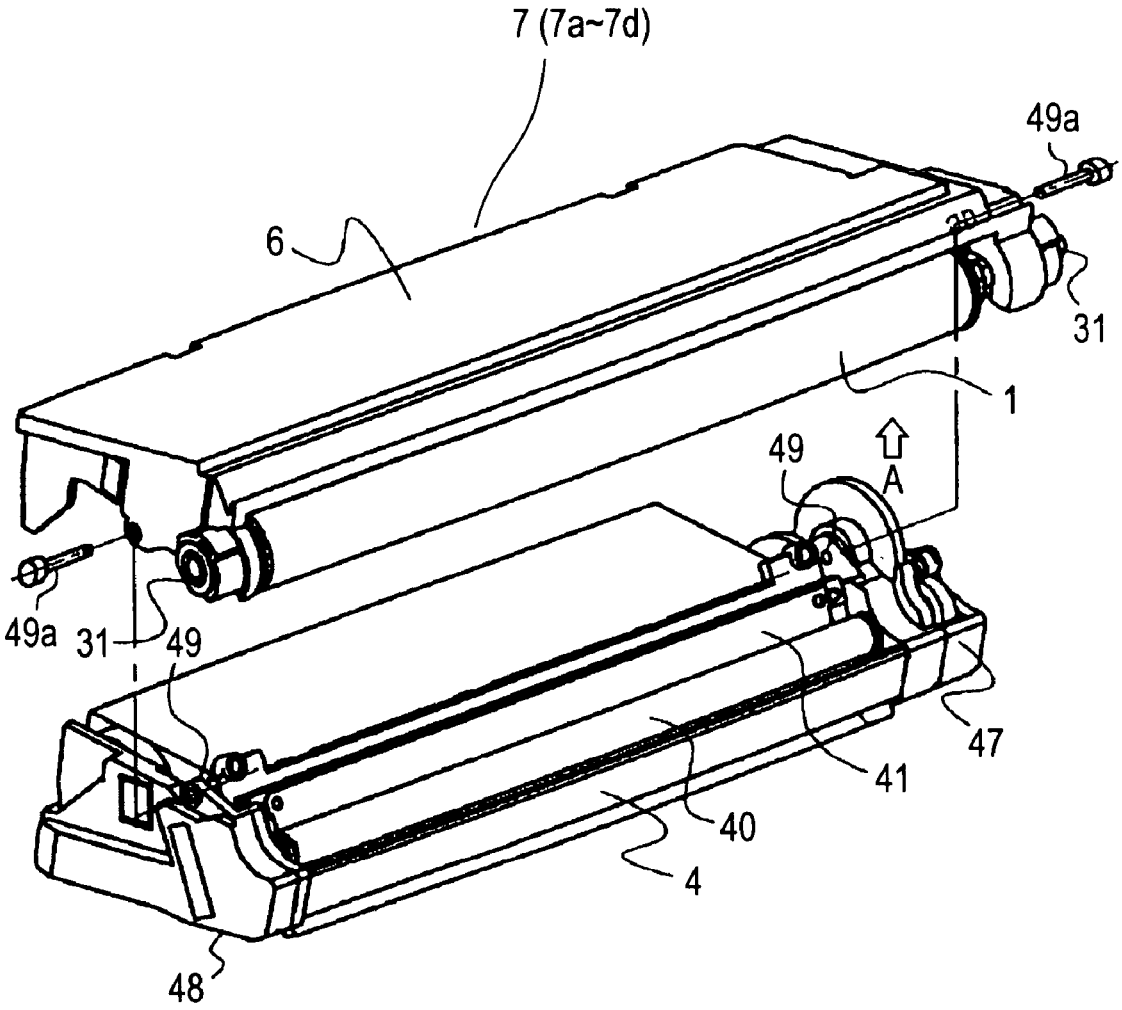
FIG. 4 is a perspective view of the partially disassembled process cartridge.
Figure 5:
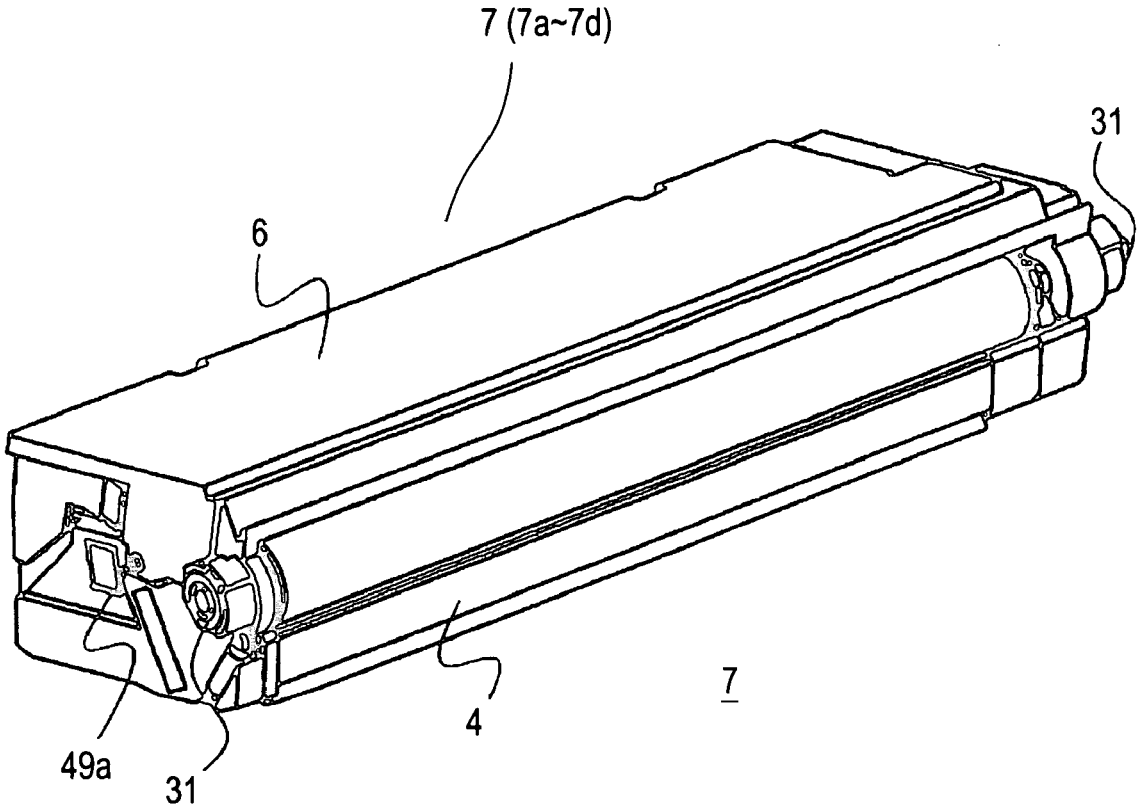
FIG. 5 is a perspective view of the process cartridge.

Next, referring to FIGS. 3, 4 and 5, the process cartridge 7 in the first embodiment of the present invention will be described. FIG. 3 is a sectional view of the cartridge 7 storing developer, and FIGS. 4 and 5 are perspective view of the cartridge 7. The four process cartridges 7*a*, 7*b*, 7*c*, and 7*d* which are storing the yellow, magenta, cyan, and black developers, respectively, are identical in structure.

Referring to FIG. 3, each process cartridge 7 is separable into a photosensitive drum unit 6 and a development unit 4 (developing apparatus). The drum unit 6 comprises the photosensitive drum 1, charger roller 2, and drum cleaning blade 60. The development unit 4 comprises the development roller 40 for developing the electrostatic latent image formed on the photosensitive drum 1.

The drum unit 6 comprises the photosensitive drum 1, and a cleaning means frame 61 to which the photosensitive drum 1 is rotatably attached with the interposition of a pair of bearings 31. As will be evident from FIG. 3, the photosensitive drum 1 is rotated in the counterclockwise direction, and the charge roller 2 as the charging member for uniformly charging the peripheral surface of the photosensitive drum 1, and the drum cleaning blade 60 as the drum cleaning member for removing the developer adhering to the peripheral surface of the photosensitive drum 1, are placed in contact with the peripheral surface of the photosensitive drum 1. In other words, the cleaning blade 60 is a member for removing the residues (developer, paper dust, etc.) adhering to the photosensitive drum 1.

After the developer, paper dust, etc., are removed by the cleaning blade 60 from the peripheral surface of the photosensitive drum 1, they are conveyed by a developer conveying mechanism 62 into a chamber 63 for removed developer, located in the rear portion (as seen from the front side of apparatus main assembly) of the cleaning means frame 61.

The development unit 4 comprises the development roller 40 which is rotated in contact with the photosensitive drum 1 (in the direction indicated by an arrow mark Y in the drawing), the developer storage portion 41 storing developer, and a developer container 45. The development roller 40 is rotatably supported by the developer container 45, with the interposition of a pair of developer shaft bearings 47 and 48 (FIG. 4). The development unit 4 also comprises: the developer supply roller 43 which is rotated in contact with the development roller 40; and the development blade 44 which is in contact with the development roller 40 (FIG. 3). Further, the development unit 4 comprises a developer conveying member 42, which is located in the developer storage portion 41 to convey the developer in the storage portion 41 to the aforementioned developer supply roller 43 while stirring the developer.

Next, referring to FIG. 4, the development unit 4 is supported by the drum unit 6, with a pair of supporting shafts 49*a* fitted in the hole 49 of the bearing 47 located at one of the lengthwise end of the development unit 4 and the hole 49 of the bearing 48 located at the other lengthwise end of the development unit 4, so that the entirety of the development unit 4 is allowed to pivot relative to the drum unit 6.

The development unit 4 is kept pressured toward the drum unit 6 by a pair of springs 64 (FIG. 3) so that when the cartridge 7 is not in the apparatus main assembly 100, the development roller 40 is kept in contact with the photosensitive drum 1 by the torque generated by the pair of springs 64 in the direction to rotate the development unit 4 about the pair of supporting shafts 49*a*.

The development process is as follows. As the developer is conveyed by the developer conveying means 42, which is being rotated (in the direction indicated by an arrow mark Z in the drawing), the developer on the peripheral surface of the developer supply roller 34 is transferred onto the peripheral surface of the development roller 40 as the peripheral surface of the developer supply roller 34, bearing the developer, rubs against the peripheral surface of the development roller 40. As a result, the developer is borne on the peripheral surface of the development roller 40. The developer borne on the peripheral surface of the development roller 40 is brought to the development blade 44 by the rotation of the development roller 40. Then, as the developer on the development roller 40 is moved past the development blade 44 by the rotation of the development roller 40, the developer on the development roller 40 is formed into a thin layer of developer with a predetermined thickness, while being given electrical charge, by the development blade 44. Then, as the development roller 40 is further rotated, this thin layer of developer is brought to the development station, in which the peripheral surfaces of the photosensitive drum 1 and development roller 40 are in contact with each other, and in which the electrostatic latent image on the peripheral surface of the photosensitive drum 1 is developed by the development roller 40 to which bias (DC voltage) is being supplied from the power source E.

The developer remaining on the peripheral surface of the development roller 40 after the development of the latent image is returned to the developer container 45 as the development roller 40 is further rotated. More specifically, it is rubbed away from the peripheral surface of the development roller 40 by the developer supply roller 43, and falls into the developer container 45.

The developer supply roller 43 is an elastic roller comprising a metallic core and a layer of foamed substance, such as sponge or the like.

[Method for Securely Attaching Drum Cleaning Blade 60 to Cleaning Means Frame 61]

Figure 6:
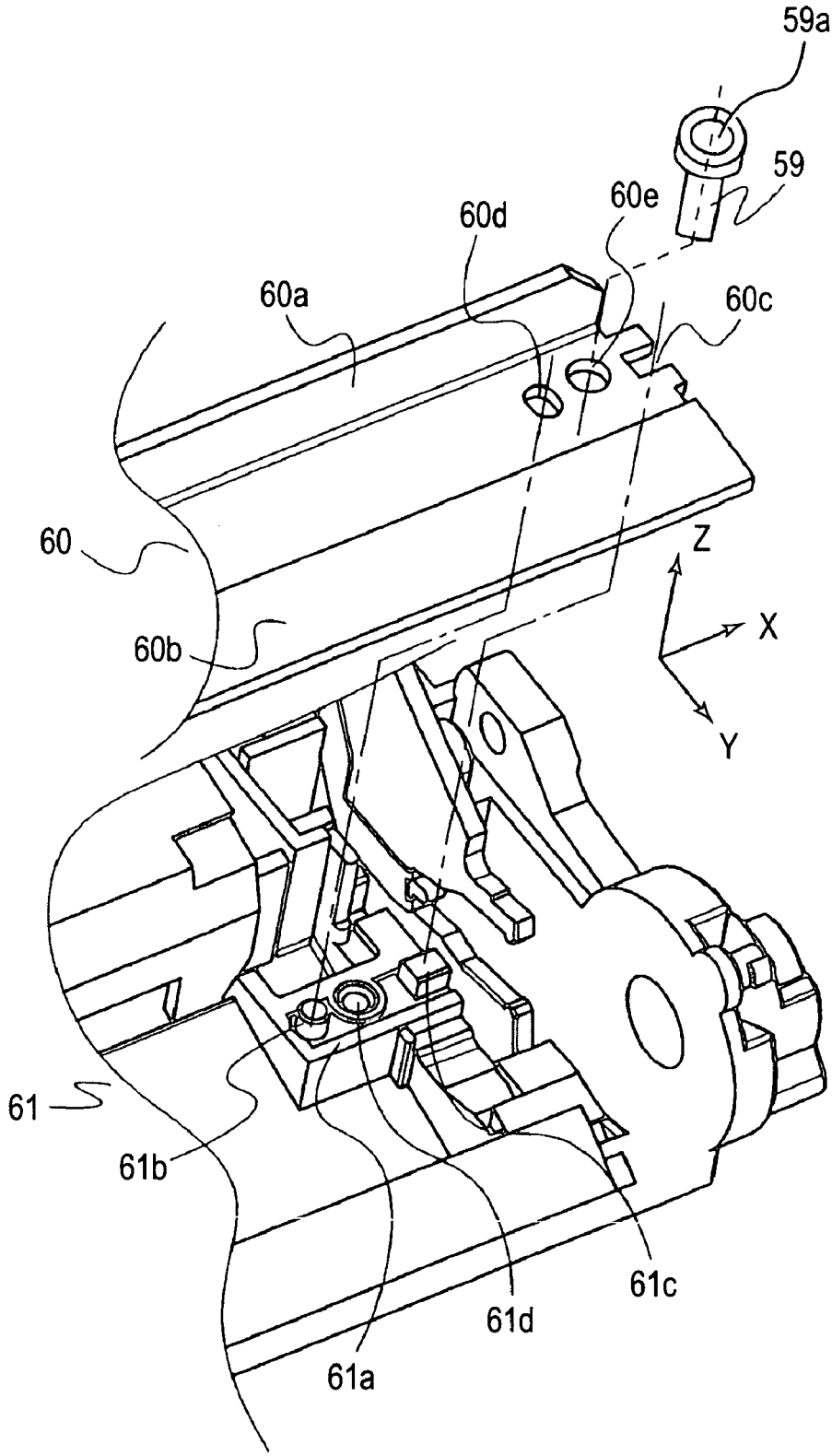
FIG. 6 is an exploded perspective view of the process cartridge in the first embodiment of the present invention.
Figure 7:
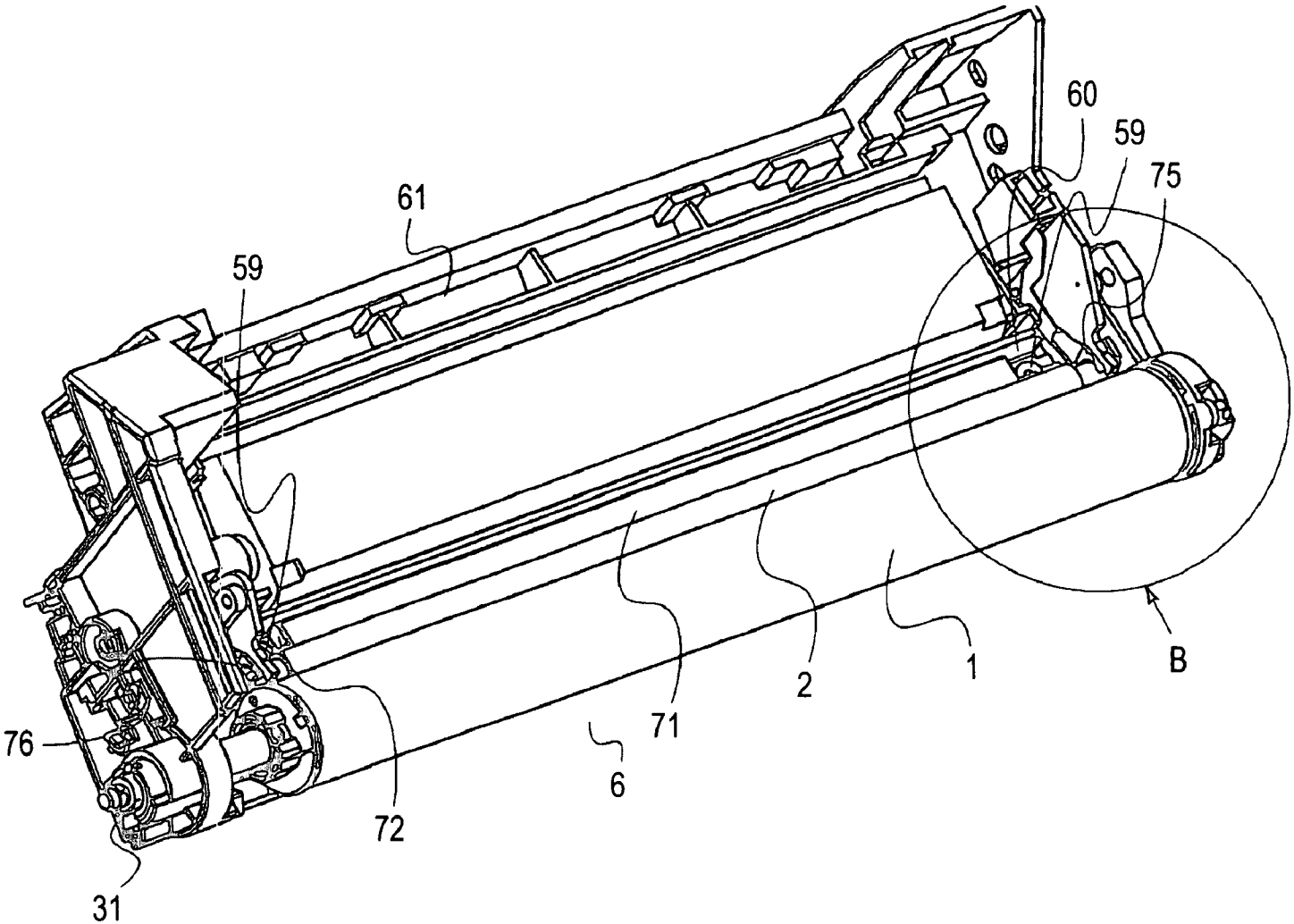
FIG. 7 is an exploded perspective view of the process cartridge in the first embodiment of the present invention.
Figure 8:
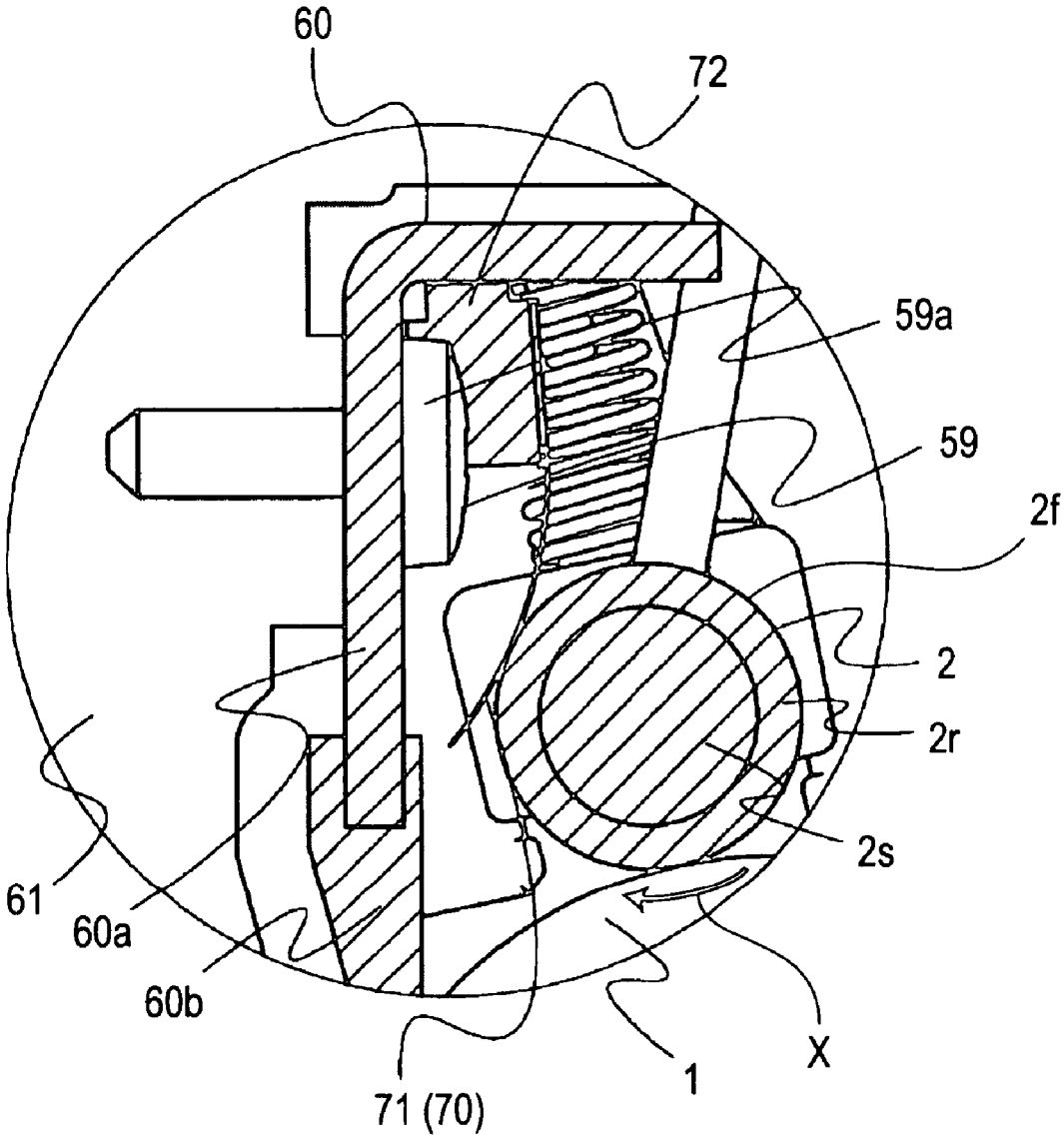
FIG. 8 is a sectional view of one of the essential portions of the process cartridge in the first embodiment of the present invention.

Next, referring to FIGS. 6, 7, and 8, the method for securely attaching the cleaning blade 60 to the cleaning means frame 61 will be described. FIGS. 6 and 7 are perspective views of the photosensitive drum unit 6 as seen from the direction indicated by an arrow mark A in FIG. 4. FIG. 6 is an enlarged exploded perspective view of the portion B of the drum unit 6 in FIG. 7, showing the essential components thereof in the separated condition.

The cleaning blade 60 comprises a metallic base 60*a* (electrically conductive member) as a supporting portion, and a rubber blade 60*b* firmly attached to the base 60*a* with the use of adhesive, molding process, or the like. In other words, the cleaning blade 60 is attached to the cleaning means frame 61 by the base 60*a*, and the blade 60*b* is supported by the base 60*a* firmly attached to the cleaning means frame 61. Each of the lengthwise ends of the base 60*a* is provided with a notch 60*c* used for accurately positioning the base 60*a* relative to the frame 61, a hole 60*d* used for accurately positioning the base 60*a* relative to the frame 61, and a hole 60*e* through which a small screw 59 as a member for securely fastening the base 60*a* (blade 60) to the cleaning means frame 61, is put. The notch 60*c* of the base 60*a* in this embodiment is a rectangular void extending in the direction parallel to the rotational axis of the photosensitive drum 1. Therefore, the dimensional errors of the base 60*a* and cleaning means frame 61 in terms of the direction parallel to the rotational axis of the photosensitive drum 1 can be absorbed by the extension of the notch 60*c* in the direction parallel to the rotational axis of the photosensitive drum 1. As for the cleaning means frame 61, it is provided with a blade seat having the surface 61*a* and bosses 61*b* and 61*c* for accurately positioning the blade 60 relative to the frame 61. Further, the blade seat of the cleaning means frame 61 is provided with a small screw hole 61*d*, which is in the surface 61*a* to securely fasten the blade 60 to the cleaning means frame 61. Incidentally, it is the blade proper 60*b* of the cleaning blade 60 that is placed in contact with the peripheral surface of the photosensitive drum 1 to remove the residues adhering to the peripheral surface of the photosensitive drum 1.

Referring to FIG. 6, the positioning of the blade 60 relative to the cleaning means fame 61 in terms of the Y direction is done by fitting the rib 61*c* on the cleaning blade seat surface 61*a* into the notch 60*c* of the blade 60, whereas the positioning of the blade 60 relative to the cleaning means frame 61 in terms of the X direction (lengthwise direction of container) is done by placing the aforementioned boss 61*b* into the hole 60*d*. The hole 60*d* is elongated in the Y direction, being enabled to absorb the errors in the measurements of the frame 61, or the like. As for the positioning of the blade 60 relative to the cleaning means frame 61 in terms of the Z direction, it is done by the height of the blade seat (surface 61*a*) from the bottom wall of the cleaning means frame 61. The blade 60 is fixed to the frame 61 with the use of a pair of fastening members 59 (for example screws) while accurately positioning the blade 60 relative to the frame 61 as described above, regulating thereby the apparent amount by which the edge of the rubber blade of the blade 60 invades into the peripheral surface of the photosensitive drum 1. Therefore, the peripheral surface of the photosensitive drum 1 is reliably cleaned. Incidentally, although FIG. 6 shows only one end of the process cartridge 7 in terms of the direction parallel to the axial line of the photosensitive drum 1, the other end of the process cartridge 7 is virtually the same as the above described end; it is provided with a notch equivalent to the above described notch 60*c*, a hole equivalent to the small screw hole 60*e*, a blade seat equivalent to the blade seat having the surface 61*a*, a boss equivalent to the boss 61*c*, and a hole equivalent to the small screw hole 60*e*. Thus, the blade 60 can be securely and accurately fixed to the frame 61. In other words, the blade 60 is fixed to the frame 61 by putting the pair of small screws 59 through the pair of holes 60*e* of the base 60*a*, and screwing them into the holes 61*d* of the frame 61, one for one.

[Attachment of Charge Roller to Cleaning Means Frame]

Next, referring to FIGS. 6 and 10, the method for attaching the charge roller 2 to the cleaning means frame 61 will be described.

Figure 10:
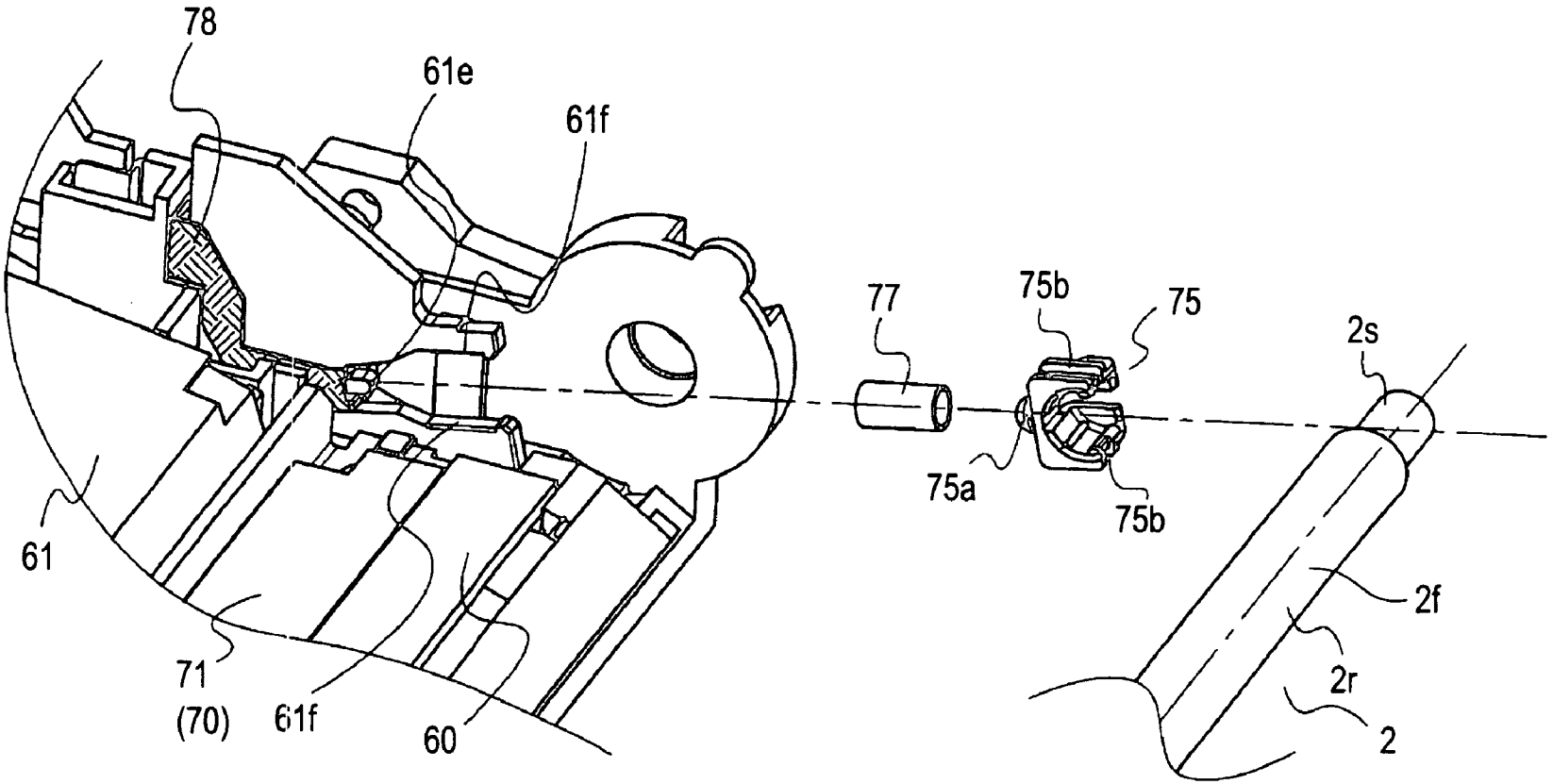
FIG. 10 is an exploded view of one of the essential portions of the process cartridge in the first embodiment of the present invention.

FIG. 10 is an enlarged exploded perspective view of the portion B in FIG. 7.

As is evident from FIG. 10, the charge roller 2 comprises a metallic shaft 2*s*, and an electrically conductive rubber roller portion 2*r* fitted around the metallic shaft 2*s*. In this embodiment, the external diameter of the shaft 2*s* is in the range of 4 mm–6 mm, and the external diameter of the rubber roller portion 2*r* is in the range of 8 mm–12 mm. The material of the rubber roller portion 2*r* is dielectric rubber, for example. The length of the rubber roller portion 2*r* is in the range of 225 mm–235 mm. The peripheral surface of this rubber roller portion 2*r* is placed in contact with the peripheral surface of the photosensitive drum 1.

The lengthwise end portions of the charge roller 2 are fitted with a pair of bearings 75 and 76 (FIG. 7), one for one, allowing the charge roller 2 to freely rotate. The bearing 75 is molded of electrically conductive resin, and is provided with a boss 75*a* for supporting a spring 77 for applying pressure to the charge roller 2. The top and bottom surfaces of the bearing 75 are provided with a pair of guide grooves 75*b*, one for one, into which the ribs (which will be described later) of the cleaning means frame 61 fit, one for one. Similarly, the bearing 76 (unshown) is provided with a boss for supporting a spring, and a pair of guide grooves.

As for the frame 61, it is provided with a pair of seats 61*e* for the pair of springs 77, and a pair of guide ribs 61*f* as portions by which the frame 16 engages with the bearings 75 and 76.

The procedure for attaching the charge roller 2 to the photosensitive drum unit 6 is as follows. First, one of the springs 77 is attached to the bearing 75. Then, the combination of the spring 77 and bearing 75 is attached to the corresponding spring seat 61*e* of the frame 61, while fitting the guide rib 61*f* of the frame 61 into the grooves 75*b*. Then, the charge roller 2 is fitted into the bearing 75, completing the process of attaching one of the lengthwise ends of the charge roller 2 to the frame 61. Although it is not shown in the drawing, the other lengthwise end of the charge roller 2, which is to be fitted with the bearing 76, is attached to the frame 61 using the same procedure as the above described one.

Also referring to FIG. 10, in the adjacencies of the spring seat 61*e* on the side where the bearing 75 is located, a piece of plate 78 as an electrode is located. The electrode 78 extends from the inward side of the frame 61 to the electrical contact (unshown) located on the outward side of the frame 61. This contact is a part of the electrical path through which the charge roller 2 receives bias from the apparatus main assembly 100. With the provision of this setup, charge bias is supplied to the charge roller 2 from the power source E located on the main assembly side, through the piece of plate 78 as the electrical contact, spring 77, and bearing 75 (electrically conductive). Referring to FIG. 7, not only does the bearing 75 support the aforementioned shaft 2*s*, but also, functions as a part of the electrical path through which bias is supplied to the charge roller 2.

[Member for Rubbing Charge Roller]

Next, referring to FIGS. 7, 8, and 9, a charging member rubbing member 70 for rubbing the peripheral surface of the charge roller 2 will be described. The foreign substances (for example, developer, paper dust, etc.) adhering to the peripheral surface of the charge roller 2 are removed by the charging member rubbing member 70 (which hereinafter may be referred to simply as rubbing member). FIG. 8 is an enlarged view of a part of FIG. 3.

Figure 9:
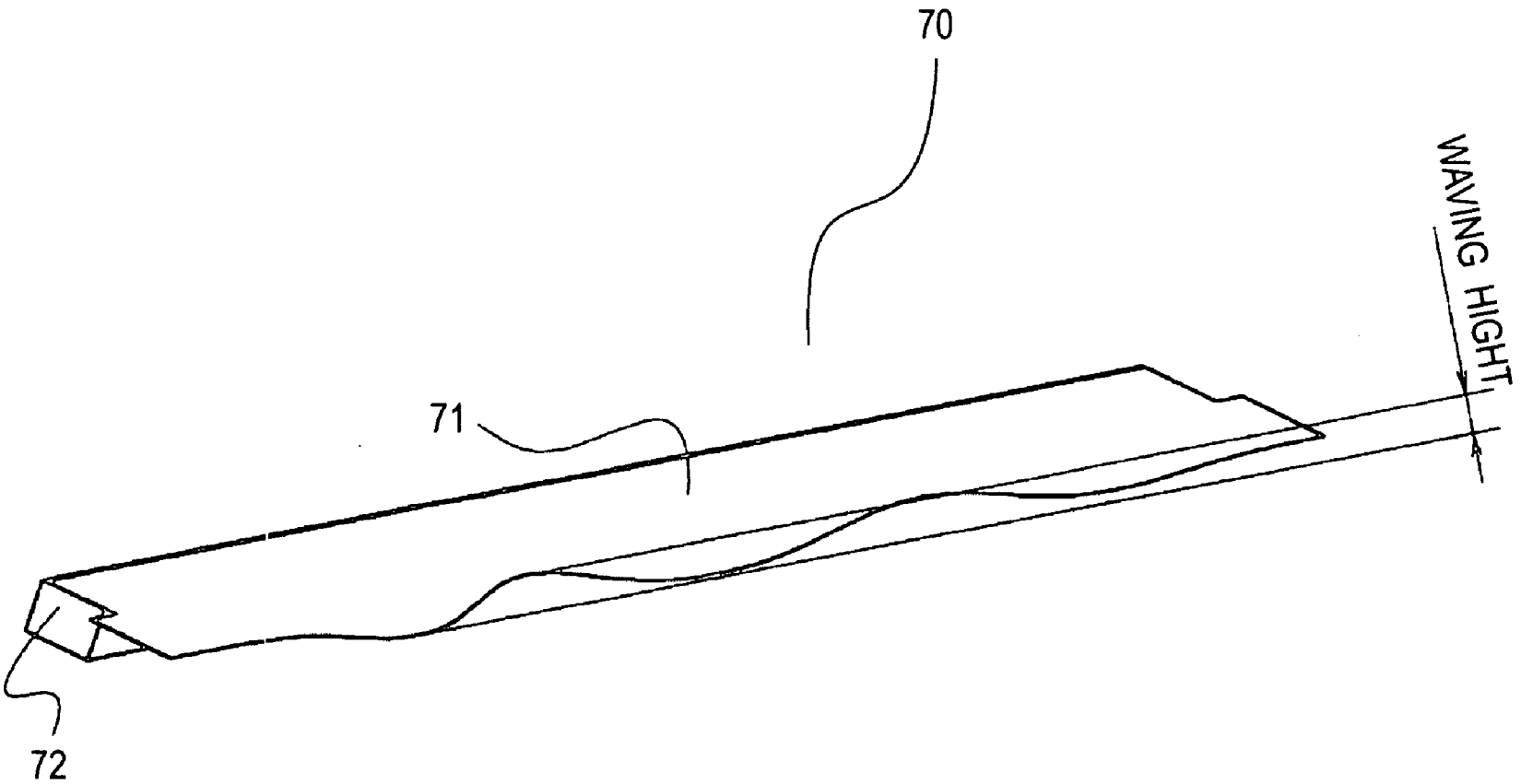
FIG. 9 is an exploded perspective view of one of the essential portions of the process cartridge in the first embodiment of the present invention.

Referring to FIG. 9, the rubbing member 70 comprises a thin elastic sheet 71 (for example, piece of 25 μm–100 μm thick film of polyimide or polyamide-imide), and a base member 72 (support portion). The sheet 71 is attached to the base 72 with the use of two-sided adhesive tape (unshown), or the like. It is for removing the foreign substances adhering to the peripheral surface of the rubber roller portion 2*r* of the charge roller 2. It is a dielectric sheet, and is extended from one lengthwise end of the rubber roller portion 2*r* to the other, being placed in contact with the peripheral surface of the rubber roller portion 2*r*. The base 72 is fixed to the base 60*a* of the blade 60 with the use of two-sided adhesive tape (unshown) or the like.

It is very important, for the following reason, that the sheet 71 is not wavy (edge of sheet 71 in contact with charge roller 2 does not form peaks and valleys) (FIG. 9), in terms of the direction parallel to the axial direction of the photosensitive. That is, if the sheet 71 is wavy, some portions of the edge of the sheet 71 fail to contact the peripheral surface of the charge roller 2, when the charge roller 2 is fitted into the bearings 75 and 76 so that the free edge of the rubbing member 70 contacts the peripheral surface of the charge roller 2 from one lengthwise end of the charge roller 2 to the other. In other words, there is the possibility that the charge roller 2 will fail to be completely cleaned. As for the dimension L0 of the sheet 71 in this embodiment, in terms of the direction perpendicular to the axial direction of the charge roller 2, of the portion of the sheet 71 flexible after the fixation of the sheet 71, is in the range of 6 mm–10 mm; the length L by which the sheet 71 is placed in contact with the charge roller 2 is in the range of 4 mm–8 mm; and the apparent amount Δ of invasion by the sheet 71 into the charge roller 2 is in the range of 2 mm–4 mm. When the amplitude δ of the waves of the sheet 71 exceeded 1 mm, sometimes virtually no contact was made between the sheet 71 and charge roller 2. As for a method for preventing the occurrence of such a situation, the curvature given in advance to the base 72 was utilized to give a certain amount of tension to the sheet 71.

Figure 11:
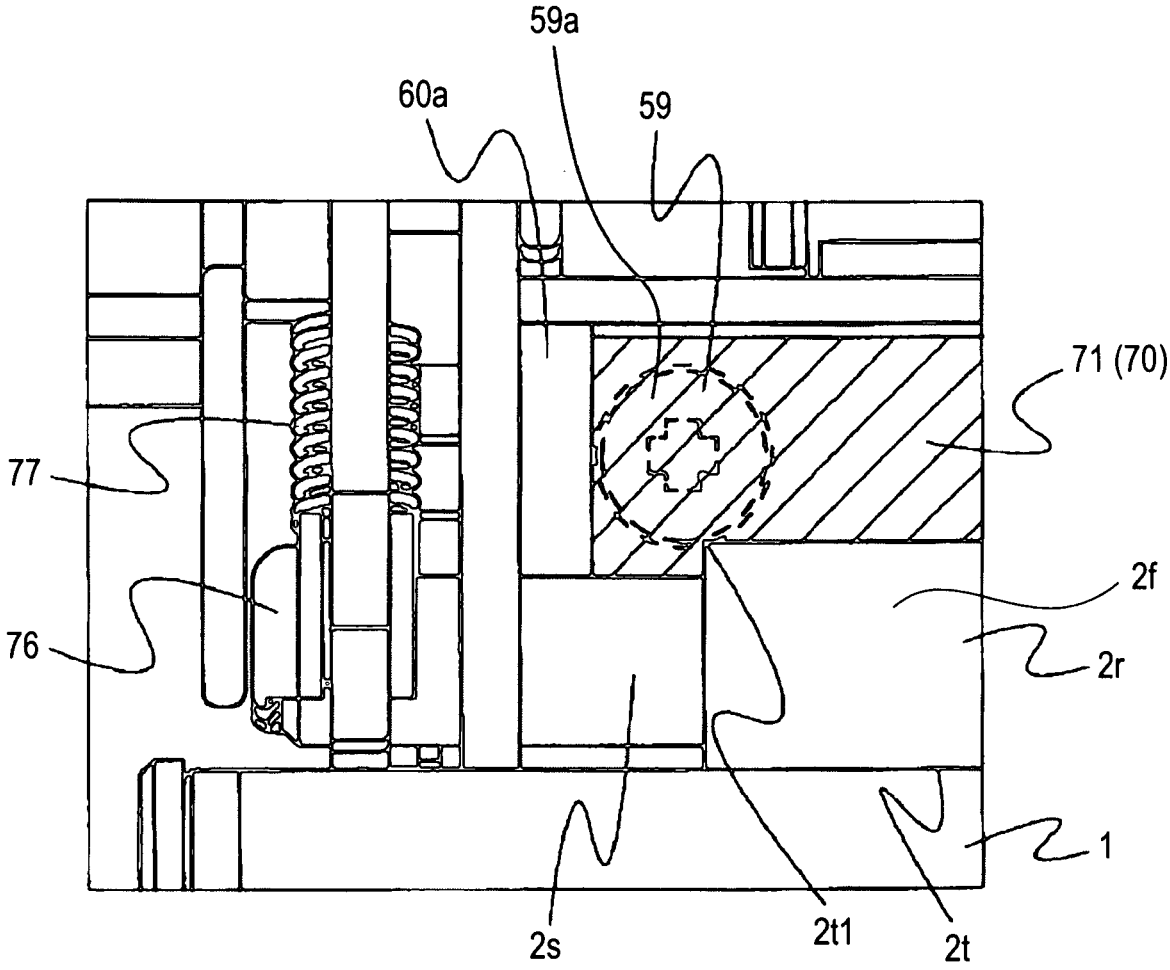
FIG. 11 is an enlarged view of one of the essential portions of the process cartridge in the first embodiment of the present invention, showing in detail the structure thereof.
Figure 12:
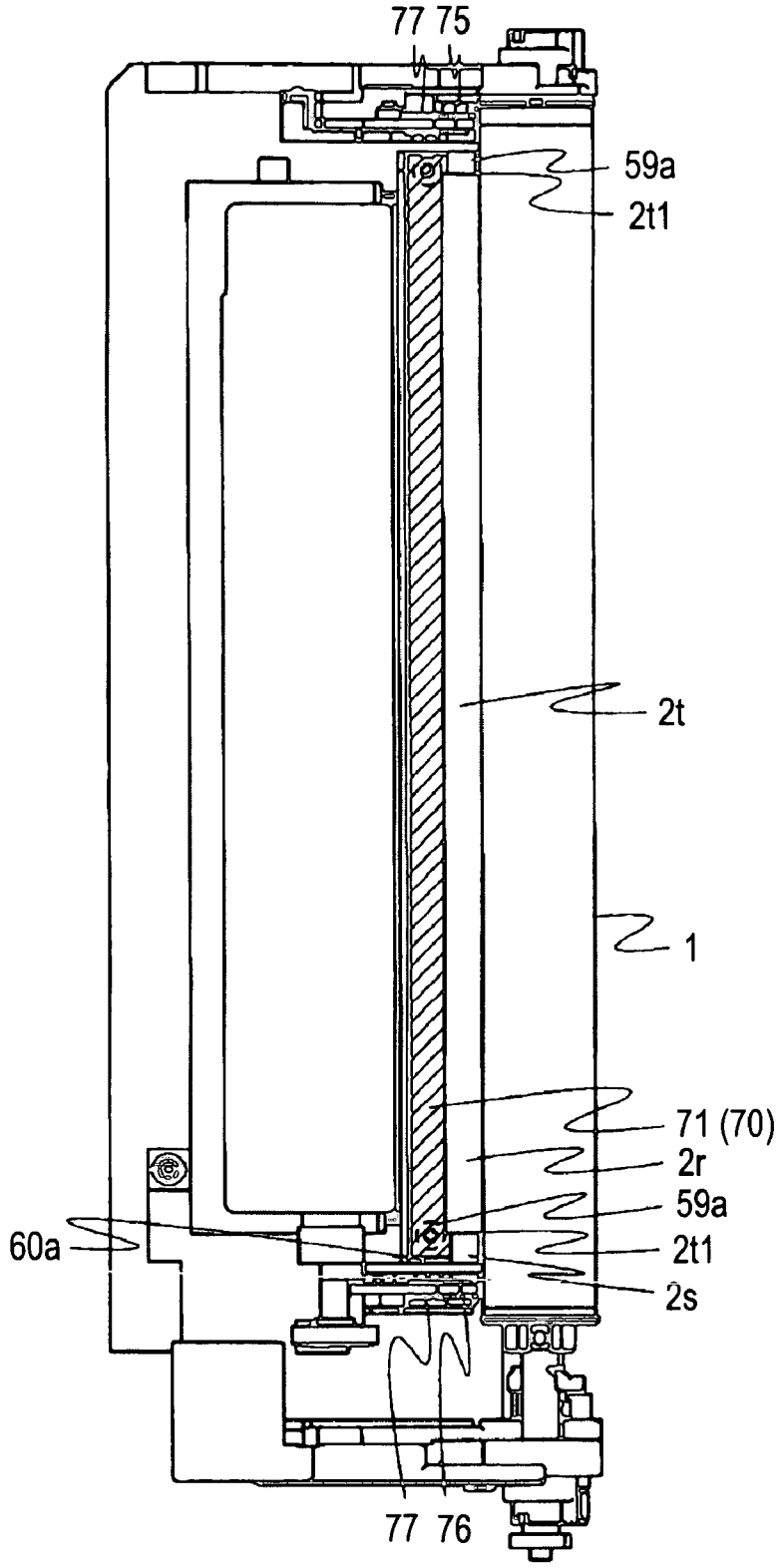
FIG. 12 is a plan view of the entirety of the process cartridge in the first embodiment of the present invention.

As for the positioning of the rubbing member 70 relative to the frame 61 in term of the X direction (lengthwise direction of frame), the rubbing member 70 is fixed to base portion 60*a* of the blade 60 while accurately positioning the rubbing member 70 relative to the base portion 60*a* of the blade 60 so that it is assured that the contact area 2*t* between the charge roller 2 and photosensitive drum 1 is fully covered by the sheet 71 (FIGS. 11 and 12). It is not mandatory for the rubbing member 70 to be attached to the blade 60; it may be directly attached to the cleaning means frame 61. Incidentally, the contact area 2*t* means the contact area between the peripheral surface of the roller portion 2*r* of the charge roller 2 and the peripheral surface of the photosensitive drum 1, created as the charge roller 2 is placed in contact with the photosensitive drum 1 to charge the photosensitive drum 1.

The charge roller 2 is supplied with high voltage (1,000 (V)–1,500 (V)). Thus, in order to prevent the electric current which flows through the charge roller 2, from leaking to the electrical components in the adjacencies of the charge roller 2, a predetermined amount of distance is provided between the charge roller 2 and each of these electrical components. On the other hand, in recent years, image forming apparatuses are desired to be ever so compact. Therefore, not only is it necessary to reduce the components of the cartridge 7 in size, but also, it is necessary to more cleverly place these components in terms of spatial efficiency. In this embodiment, therefore, the process cartridge 7 is designed to minimize the distance between the charge roller 2 and each of the electrically conductive components (electrically conductive members) placed in the adjacencies of the charge roller 2. Further, the dielectric substance (dielectric strength is in range of 3–20 kV/mm) is used as the material for the sheet 71 as the charging member rubbing member 70. In addition, in terms of the lengthwise direction of the charge roller 2, the sheet 71 which is elastically placed in contact with the charge roller 2 is made longer than the contact area between the peripheral surfaces of the charge roller 2 and photosensitive drum 1, that is, long enough to extend a predetermined length from the each lengthwise end 2*t*1 of the contact area 2*t* (roller portion 2*r*) through which the photosensitive drum 1 is charged by the charge roller 2, as shown in FIGS. 11 and 12.

Moreover, the sheet 71 is made long enough and is placed so that it is positioned between the roller portion 2*r* of the charge roller 2 and the head portion 59*a* of the small screw 59 (electrically conductive member). In other words, in order to place the sheet 71 between the small screw 59 and the charge roller 2, the sheet 71 is made long enough to extend beyond each lengthwise end 2*t*1 of the contact area 2*t* through which the photosensitive drum 1 is charged by charge roller 2; it is made long enough to cover the entire area of the head portion 59*a* of the small screw 59.

In other words, not only is the sheet 71 elastically placed in contact with the rubber roller portion 2*r* of the charge roller 2 across the entire range of the rubber roller 2*r* in terms of the lengthwise direction thereof, but also, it is made long enough for each of the lengthwise end portions of the sheet 71 to extend between the rubber roller portion 2*r* and the head portion 59*a*.

Therefore, even if ordinary small screws are used as fastening members, the distance between the charge roller 2 and each fastening member can be reduced. In other words, ready available components can be used as the fastening members, making it possible to accomplish cost reduction.

Further, not only does the provision of the sheet 7 in accordance with the present invention make it possible to clean the peripheral surface of the charge roller 2 (rubber roller portion 2*r*), but also, to prevent electric current from leaking between the charge roller 2 and small screw 59. In other words, the provision of the sheet 71 saves the labor for attaching a component dedicated to the prevention of electric current leak, improving thereby the cartridge assembly efficiency.

Incidentally, the sheet 71 (charging member rubbing member 70) is placed in contact with the peripheral surface 2*f* of the actual roller portion 2*r* of the charge roller 2, and rubs the peripheral surface 2*f* as the charge roller 2 is rotated. More specifically, in terms of the rotational direction (direction of arrow X in FIG. 8) of the charge roller 2, in other words, in terms of the direction parallel to the shorter edges of the sheet 71, the sheet 71 is in contact with the peripheral surface 2*f* of the charge roller 2, by the area inward of its longer edge (so-called belly contact in Japanese jargon). It is thought that as the sheet 71 placed in contact with peripheral surface 2*f* (numerous minute bodies of developer on peripheral surface 2*f*) of the charge roller 2 rubs the peripheral surface 2*f*, it evenly spread the minute bodies of developer adhering to the peripheral surface 2*f* of the charge roller 2, across the entirety of the peripheral surface 2*f*. Further, as the sheet 71 rubs the numerous minute bodies of developer on the peripheral surface of the charge roller 2, it frictionally charges the developer. As a result, the amount of the force working in the direction to keep the developer adhered to the peripheral surface 2*f* is reduced, allowing (causing) the developer to return to the peripheral surface of the photosensitive drum 1 from the roller portion 2*r*; in other words, the peripheral surface 2*f* of the charge roller 2 is cleaned by the sheet 71. As a result, one of the problems which are likely to occur if the sheet 7 is not provided, more specifically, the formation of unwanted streaks of developer, on the roller portion 2*r*, which extend in the rotational direction of the roller portion 2*r*, can be prevented.

Incidentally, in this embodiment, the length of the roller portion 2*r* is set to roughly 280 mm, whereas the length of the sheet 71 is set to roughly 320 mm. With the employment of this arrangement, the sheet 71 extends beyond both lengthwise ends of the roller portion 2*r*. The length by which the sheet 71 extends beyond each of the lengthwise ends of the roller portion 2*r* is roughly 20 mm.

Also with this structural arrangement, even if the distance between the small screw 59 and charge roller 2 (roller portion 2*r*) is shorter than that in accordance with the prior art, it is possible to prevent electric current leak from occurring between the small screw 59 and charge roller 2; in other word, it is possible to prevent the electric current supplied to the charge roller 2, from leaking to the small screw 59. More specifically, in the case of a process cartridge in accordance with the prior art, the aforementioned distance had to be in the range of 1.0 mm–1.5 mm. However, in the case of the process cartridge 7 in accordance with the present invention, even when the distance was reduced to a value no more than 1.0 mm, the aforementioned electric current leak did not occur as long as the electrophotographic image forming apparatus employing the process cartridge 7 was used in the normal environment.

In other words, the electric current leak did not occur at all even in a severe environment (for example, highly humid environment) in which the leak was likely to occur if the sheet 71 were not provided.

Therefore, it is possible to reduce the cartridge 7 in size. Further, in terms of the direction parallel to the lengthwise direction of the charge roller 2, the rubbing member 70 is made longer than the contact area 2*t* between the peripheral surfaced of the charge roller 2 and photosensitive drum 1. Therefore, not only is the rubbing member 70 given the function of cleaning the peripheral surface of the charge roller 2, but also, the function of preventing electric current from leaking from the charge roller 2 to the small screws 59 (electrically conductive members).

Embodiment 2

Figure 13:
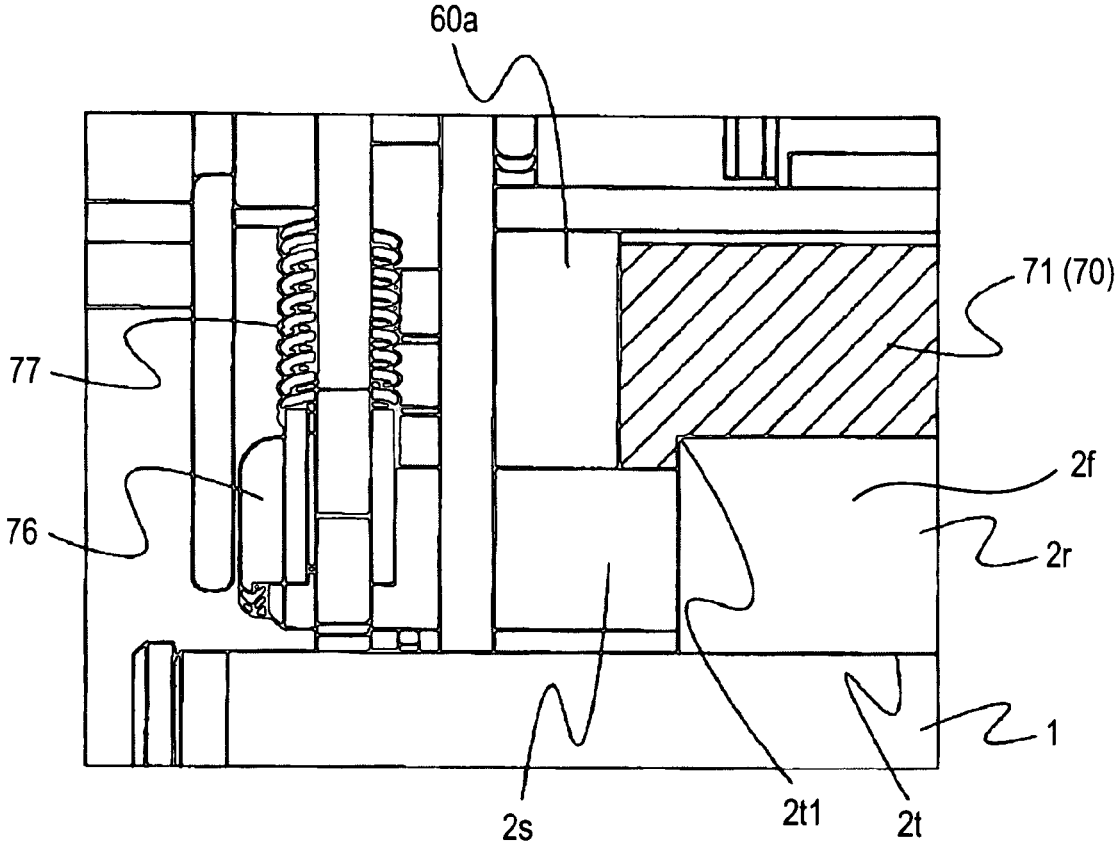
FIG. 13 is an enlarged view of one of the essential portions of the process cartridge in the first embodiment of the present invention, showing in detail the structure thereof.
Figure 14:
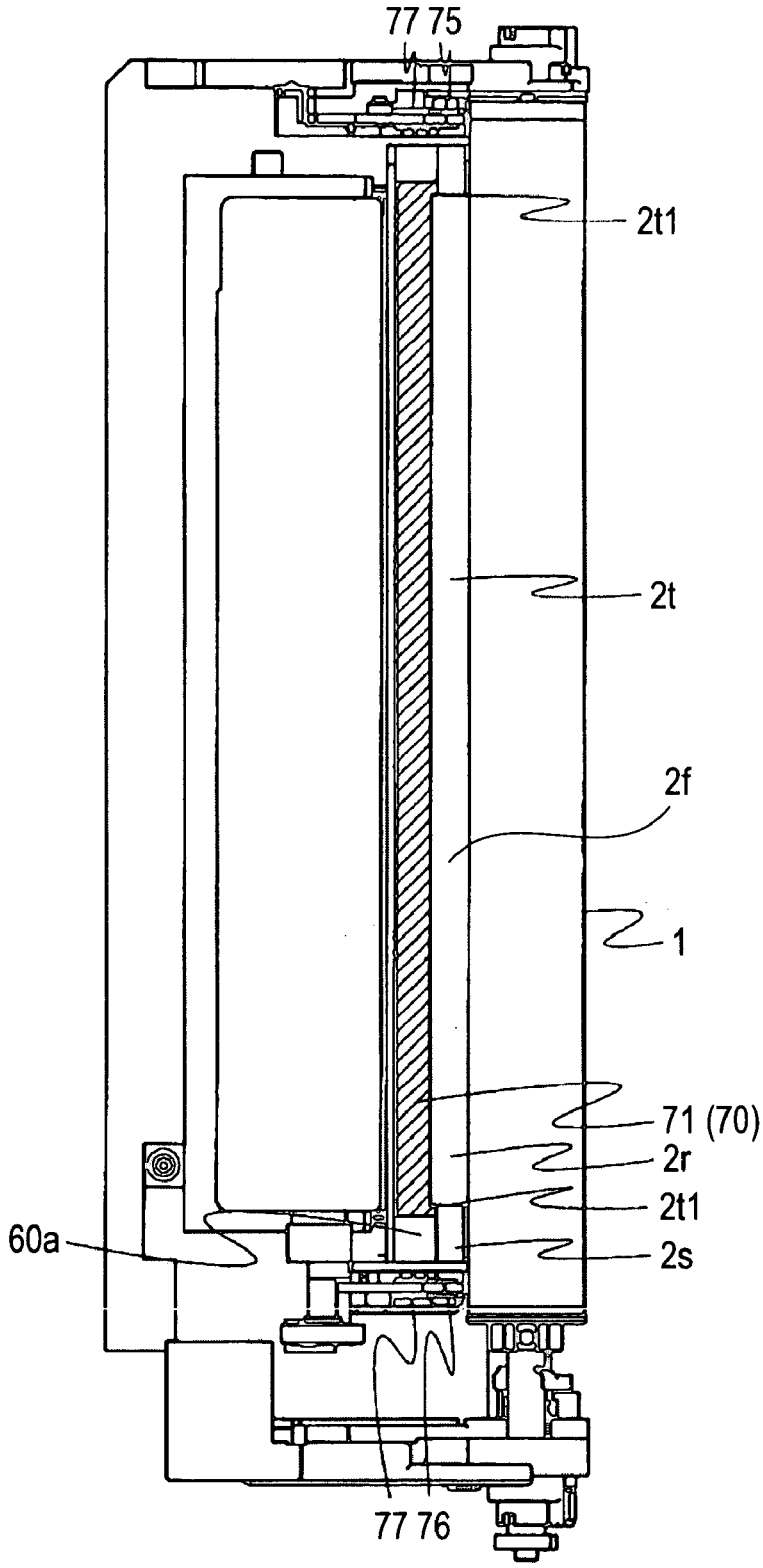
FIG. 14 is a plane view of the entirety of the process cartridge in the second embodiment of the present invention.
Figure 15:
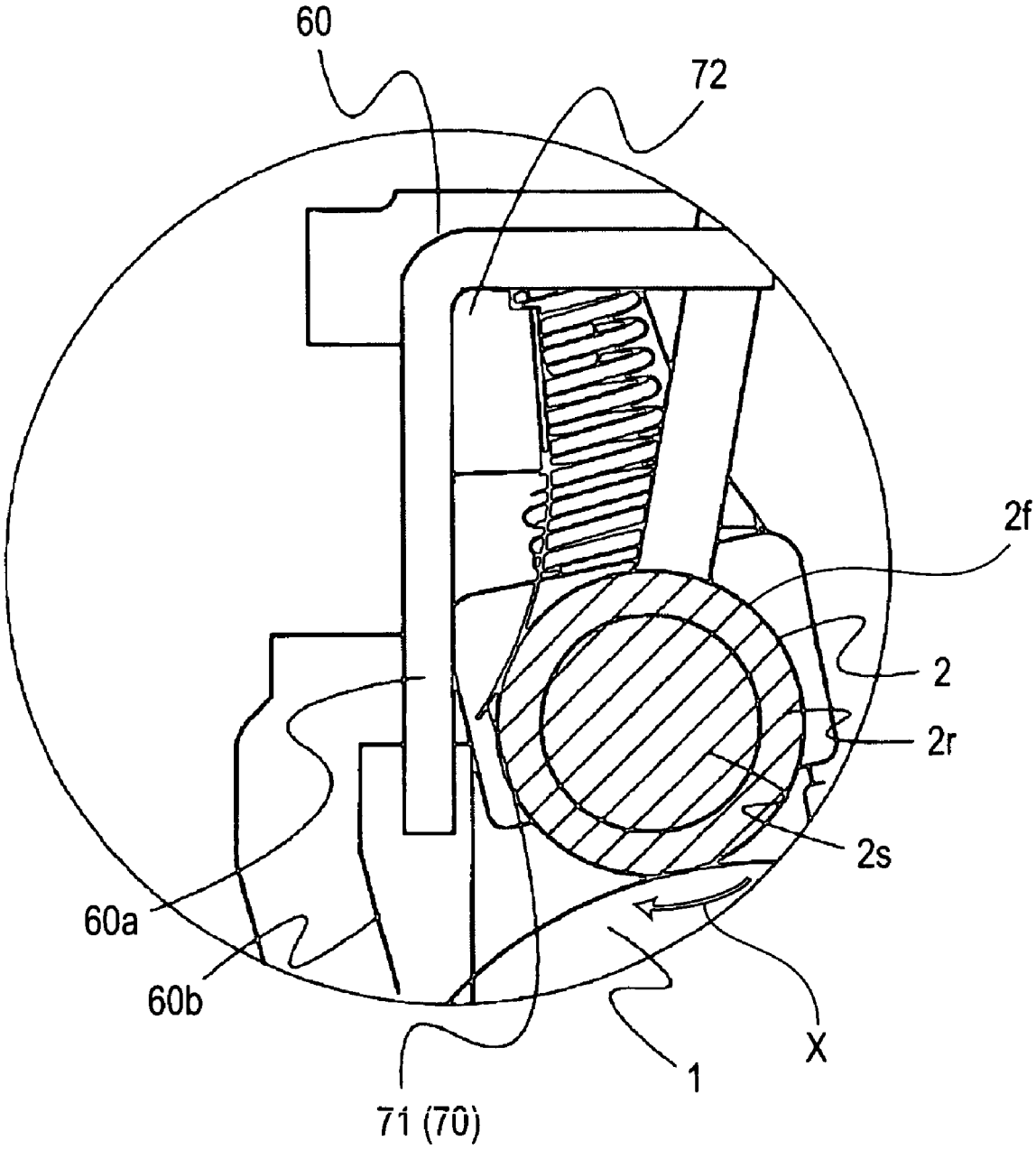
FIG. 15 is a sectional view of one of the essential portions of the process cartridge in the second embodiment of the present invention.

Next, referring to FIGS. 13, 14, and 15, another embodiment of the present invention will be described. FIG. 13 is an enlarged view of one of the lengthwise ends of the charge roller 2, and its adjacencies, showing in detail the structures thereof, and FIG. 14 is a drawing depicting the relationship between the charge roller 2 and sheet 71 in terms of the their lengthwise direction. FIG. 15 is a drawing depicting the relationship between the charge roller 2 and sheet 71.

In this embodiment, the drum cleaning member 60 is attached to the frame 61 with the use of two-sided adhesive tape (unshown), instead of the pair of small screws.

Also in this embodiment, the sheet 71 extends beyond both lengthwise ends 2*t*1 of the contact area 2*t*, reaching the range of the portions of the metallic shaft 2*s* exposed from the roller portion 2*r*. Therefore, electric current is prevented from leaking from the charge roller 2 to the base 60*a* (electrically conductive member) as the cleaning blade supporting portion in the form of a piece of flat metallic plate. With the employment of this structural arrangement, even if the distance between the base 60*a* and charge roller 2 is reduced to a value substantially smaller than the distance in accordance with the prior art, the electric current supplied to the charge roller 2 does not leak to the base.

Incidentally, in this embodiment, the sheet 71 is not made to cover the base 60*a* across its entire range in terms of their lengthwise direction, for the following reason. That is, as long as the sheet 71 extends as far as the locations shown in FIGS. 13 and 14, the distance between the portion of the base 60*a* not covered with the sheet 71, and the roller portion 2*r* of the charge roller 2, is large enough to prevent the occurrence of the electric current leak. The distance between the shaft 2*s* and base 60*a* is large enough to prevent the occurrence of the leak, because the diameter of the shaft 2*s* is substantially smaller than that of the roller portion 2*r*.

[Miscellanies]

In the preceding embodiments of the present invention, the process cartridge was a cartridge in which a charging member as a processing means, and an electrophotographic photosensitive drum, were integrally placed, and which was removably mountable in the main assembly of an electrophotographic image forming apparatus. However, the application of the present invention is not limited to such a process cartridge. For example, a process cartridge may comprise a developing member and/or cleaning member, as processing means, in addition to a charging member.

In the first embodiment, the sheet 71 was extended beyond both lengthwise ends of the contact area between the charge roller 2 and photosensitive drum 1, being placed between the small screws 59 and charge roller 2. This is because the small screws 59 are located at both lengthwise ends of the blade 60. However, in some cases, the sheet 71 needs to be extended beyond only one of the lengthwise ends of the aforementioned contact area; for example, in the case of a process cartridge in which the small screw 59 is located at only one lengthwise end of the blade 60, a process cartridge in which the distance between the small screw 59 and charge roller 2 at one lengthwise end is long enough to prevent the occurrence of the leak, or the like process cartridges.

Further, in each of the preceding embodiments, the sheet 71 was elastic, and dielectric (its dielectric strength was in the range of 3–20 kV/mm). Its dielectric strength was measured with the use of the method defined in JIS C2110: 1994. If the dielectric strength of the sheet 71 is no more than 3 kV/mm, it is possible that the leak will occur under certain environmental conditions. On the other hand, using a dielectric sheet, the dielectric strength of which is no less than 20 kV/mm, as the material for the sheet 71, prevents the occurrence of the leak, but, such sheet is difficult to commercially obtain. In comparison, a dielectric sheet, the dielectric strength of which is no more than 20 kV/mm, is easier to commercially obtain. Therefore, using the sheet, the dielectric strength of which is no more than 20 kV/mm, does not result in cost increase.

In the above described first embodiment, the electrically conductive member is the small metallic screws 59 for fixing the drum cleaning member 60 to the cleaning means frame 61, whereas in the second embodiment, it is the base 60*a*, in the form of a piece of flat metallic plate, of the drum cleaning member 60 for supporting the blade 60*b* of the drum cleaning member 60. However, the electrically conductive members in the adjacencies of the charge roller 2 (shaft, roller portion, etc.), which can be electrically shielded as described above, are not limited to the above described two; any of the electrically conductive members in the adjacencies of the charge roller 2 can be electrically shielded by the above described method or the like.

Also in the above described embodiments, the charging member was the charge roller 2, that is, a charge roller in the form of a roller. This does not means that the application of the present invention is limited to charging members in the form of a roller. In other words, the present invention is applicable to any charging member which is placed in contact with an electrophotographic photosensitive drum in order to charge the electrophotographic photosensitive drum by being supplied with charge bias from the apparatus main assembly. For example, the present invention is applicable to a structural arrangement in which the charge roller is in the form of an endless belt (charge belt) circularly rotatable in contact with the photosensitive drum to charge the photosensitive drum, and such an application yields the same effects as those described above.

In the case of a process cartridge in accordance with the prior art, when supplying the charge roller 2 with charge bias of roughly 1,000 V, the standing rule regarding the distance between the charge roller 2 and any of the electrically conductive members (components) was that the distance was to be no less than 1.0 mm, for the following reason. That is, if the distance was no more than 1.0 mm, it was possible that the electric current leak would occur when the peripheral surface 7 was used in a severe environment, for example, highly humid environment.

In comparison, in the case of the process cartridge 7 in accordance with the present invention, even if the distance between the charge roller 2 and any of the electrically conductive members in the adjacencies of the charge roller 2 is reduced to a value as small as 0.7 mm, there is no possibility that electric current leak will occur between the charge roller 2 and any of the electrically conductive members in the adjacencies of the charge roller 2.

In other words, the possibility that the electric current leak will occur when an electrophotographic image forming apparatus is used in a relatively severe environment is eliminated. Thus, according to the above described embodiments, the distance between the charge roller 2 and any of the electrically conductive members in the adjacencies of the charge roller 2 could be reduced to a value as small as 0.7 mm.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 280121/2003 and 152969/2004 filed Jul. 25, 2003 and May 24, 2004, respectively, which are hereby incorporated by reference.

What is claimed is:

1. A process cartridge detachably mountable to a main assembly of an electrophotographic image forming apparatus, said process cartridge comprising:

an electrophotographic photosensitive drum;

a charging member configured and positioned to electrically charge said electrophotographic photosensitive drum, wherein said charging member is supplied with a charging bias voltage received from the main assembly of the electrophotographic image forming apparatus when said process cartridge is mounted to the main assembly of the electrophotographic image forming apparatus; and a charging-member rubbing member having an insulative property and contacting said charging member along a longitudinal direction of said charging member, wherein said charging member contacts said electrophotographic photosensitive drum within a longitudinally extending range to electrically charge said electrophotographic photosensitive drum, and wherein said charging-member rubbing member is disposed between an electroconductive member and said charging member beyond an end of said range to prevent leakage of current from said charging member to the electroconductive member when said charging member is supplied with the charging bias.

2. A process cartridge according to claim 1, further comprising a drum cleaning member configured and positioned to remove deposited matter from said electrophotographic photosensitive drum, wherein the electroconductive member is a screw composed of metal configured and positioned to fix said drum cleaning member on a cartridge frame.

3. A process cartridge according to claim 1, further comprising a drum cleaning member configured and positioned to remove deposited matter from said electrophotographic photosensitive drum, wherein the electroconductive member is a supporting portion in the form of a metal plate configured and positioned to support a blade constituting said drum cleaning member, and said drum cleaning member is mounted on a cartridge frame by the metal plate being fixed on the cartridge frame.

4. A process cartridge according to claim 1, 2 or 3, wherein said charging-member rubbing member is disposed between the electroconductive member and said charging member beyond each of longitudinal ends of said range.

5. A process cartridge according to claim 4, wherein said charging-member rubbing member covers the entire area of the electroconductive member in the longitudinal direction.

6. A process cartridge according to any one of claims 1–3, wherein said charging-member rubbing member has a withstand voltage of 3–20 kV/mm.

7. A process cartridge according to claim 6, wherein said charging member comprises a charging roller, wherein said charging-member rubbing member is in the form of an elastic sheet which elastically contacts a roller portion of said charging roller along the longitudinal direction of the roller portion, and wherein an end of the sheet is disposed between the roller portion and a head portion of a screw constituting the electroconductive member.

8. An electrophotographic image forming apparatus for forming an image on a recording material, said apparatus comprising:

(1) a main assembly voltage source of a main assembly of said electrophotographic image forming apparatus;

(2) a mounting portion; and (3) a process cartridge detachably mounted to said mounting portion, said process cartridge including:

a charging member configured and positioned to electrically charge an electrophotographic photosensitive drum, wherein said charging member is supplied with a charging bias voltage received from said main assembly voltage source of the main assembly of said electrophotographic image forming apparatus when said process cartridge is mounted to the main assembly of said electrophotographic image forming apparatus; and a charging-member rubber member having an insulative property and provided to contact said charging member along a longitudinal direction of said charging member, wherein said charging member contacts the electrophotographic photosensitive drum within a longitudinally extending range of the electrophotographic photosensitive drum, and wherein said charging-member rubbing member is disposed between an electroconductive member and said charging member beyond an end of said range to prevent leakage of current from said charging member to the electroconductive member when said charging member is supplied with the charging bias.

* * * * *

UNITED STATES PATENT AND TRADEMARK OFFICE

CERTIFICATE OF CORRECTION

PATENT NO. : 7,088,939 B2
APPLICATION NO. : 10/896281
DATED : August 8, 2006
INVENTOR(S) : Hideki Maeshima et al.

It is certified that error appears in the above-identified patent and that said Letters Patent is hereby corrected as shown below:

COLUMN 1:
Line 38, "transfers" should read --transfer--.
Line 51, "electrically current" should read --electrical current--.

COLUMN 3:
Line 1, "is" should be deleted.

COLUMN 13:
Line 46, "are" should be --is--.

Signed and Sealed this

Tenth Day of July, 2007

JON W. DUDAS
*Director of the United States Patent and Trademark Office*